US009794700B2

(12) United States Patent
Saltykov

(10) Patent No.: US 9,794,700 B2
(45) Date of Patent: Oct. 17, 2017

(54) HEARING AID WITH OCCLUSION REDUCTION

(75) Inventor: Oleg Saltykov, Fairlawn, NJ (US)

(73) Assignee: Sivantos Inc., Piscataway, NJ (US)

( * ) Notice: Subject to any disclaimer, the term of this patent is extended or adjusted under 35 U.S.C. 154(b) by 386 days.

(21) Appl. No.: 13/176,104

(22) Filed: Jul. 5, 2011

(65) Prior Publication Data

US 2012/0008808 A1 Jan. 12, 2012

Related U.S. Application Data

(60) Provisional application No. 61/362,717, filed on Jul. 9, 2010.

(51) Int. Cl.
*H04R 1/10* (2006.01)
*H04R 25/00* (2006.01)

(52) U.S. Cl.
CPC ..... *H04R 25/48* (2013.01); *H04R 2225/025* (2013.01); *H04R 2460/05* (2013.01); *H04R 2460/11* (2013.01)

(58) Field of Classification Search
USPC ..... 381/318, 93
See application file for complete search history.

(56) References Cited

U.S. PATENT DOCUMENTS

| | | | | |
|---|---|---|---|---|
| 3,780,824 | A | 12/1973 | Prince | |
| 4,987,597 | A | 1/1991 | Haertl | |
| 6,176,345 | B1 | 1/2001 | Perkins et al. | |
| 8,130,992 | B2 * | 3/2012 | Munk et al. | 381/318 |
| 2003/0228027 | A1 * | 12/2003 | Czerwinski | 381/342 |
| 2005/0018866 | A1 | 1/2005 | Schulein et al. | |
| 2007/0086599 | A1 * | 4/2007 | Wilmink | A61F 11/08 381/74 |
| 2008/0063228 | A1 | 3/2008 | Mejia et al. | |
| 2009/0238388 | A1 | 9/2009 | Saltykov et al. | |
| 2010/0014696 | A1 * | 1/2010 | Boschung et al. | 381/328 |
| 2011/0069852 | A1 | 3/2011 | Arndt et al. | |

FOREIGN PATENT DOCUMENTS

| | | |
|---|---|---|
| WO | 92/21218 | 11/1992 |
| WO | 2006037156 | 4/2006 |
| WO | 2006108099 | 10/2006 |

OTHER PUBLICATIONS

Studebaker G.A., "The Acoustical Effect of Various Factors on the Frequency Response of a Hearing-Aid Receiver", Journal of the Audio Engineering Society, New York, NY, vol. 22, No. 5, Jun. 1, 1974, pp. 329-334.

European Search Report for Application No. EP 10 17 0145 dated Sep. 15, 2010.

(Continued)

*Primary Examiner* — Amir Etesam

(74) *Attorney, Agent, or Firm* — Laurence A. Greenberg; Werner H. Stemer; Ralph E. Locher

(57) ABSTRACT

A hearing aid having hearing loss-compensating components, active occlusion reduction components, a vent, a tuned piston, and a flexible surround. The piston and the surround combination are assembled on the faceplate and cover the outside end of the vent that is situated on the faceplate. The piston and the surround combination minimize the adverse effects of walk-induced head vibrations.

14 Claims, 3 Drawing Sheets

(56) References Cited

OTHER PUBLICATIONS

Mejia, J., et al., "Active Cancellation of Occlusion: An Electronic Vent for Hearing Aids and Hearing Protectors", J. Accoust. Soc. Am. 124 (1) , Jul. 2008, pp. 235-240.
Knowles Electronics, Inc. Technical Bulletin, TB5, "Walk Induced Head Vibrations and Hearing Aid Design", http://www.knowles.com/search/pdf/TB-05.pdf, downloaded on Jul. 5, 2011, pp. 1-4.
Ingard et al., "The Impedance of a Resistance Loaded Helmholtz Resonator", Journal of the Acoustical Society of America, Melville, NY, vol. 25, No. 5, Sep. 1, 1953, pp. 854-857.
European Search Report in EP Patent Application No. 11172806 dated Jul. 7, 2014, 10 pages.

* cited by examiner

HEARING AID WITH OCCLUSION REDUCTION

CROSS-REFERENCE TO RELATED APPLICATIONS

This application claims the benefit of Provisional U.S. Patent Application Ser. No. 61/362,717 entitled, "Occlusion Reduction System With A Tuned Piston", filed in the name of Oleg Saltykov on Jul. 9, 2010, the disclosure of which is hereby incorporated by reference herein.

FIELD OF INVENTION

The invention relates to a hearing aid. More particularly, the invention relates to a hearing aid that provides occlusion reduction.

BACKGROUND OF THE INVENTION

A conventional hearing aid typically comprises a housing that defines a generally closed cavity therein in which are arranged a power source, an input transducer, for example, a microphone, and associated amplifier for transforming external sounds into electrical signals, a signal processor for processing the transformed signals and producing signals optimized for particular hearing losses, and an output transducer, called a receiver, for transforming the processor signals into hearing-loss compensated sounds that are emitted into the ear. A hearing aid typically also comprises respective sound tubes extending from the input port of the microphone or the output port of the receiver to the housing outside surface to establish acoustic pathways between the microphone and the outside surroundings and between the receiver and the ear canal, respectively.

Hearing aids may be constructed to be wearable in the ear (for example, in-the-ear (ITE); in-the-canal (ITC), and completely-in-the-canal (CIC) hearing aids). For this type of hearing aid, the ear canal is either partially or completely closed off from the surroundings outside the ear. So-called "occlusion effects" are a consequence of this occlusion of the ear canal. Specifically, there occurs a pressure build-up in the residual volume of the unblocked portion of the ear canal, defined by the hearing aid and the ear drum, from the sound emitted by the vibration of the tissue in the ear canal that is normally caused by the voice of the hearing aid user. The voice of the hearing aid user becomes amplified and hollow and dominates the sounds reaching the ear drum. This results in poor sound quality of the user's own voice as well as the other sounds reaching the ear drum.

There are several ways to diminish or reduce these occlusion effects. For example, a hearing aid may be configured to have at least one ventilation channel or passage ("vent") that extends from the portion of the hearing aid housing facing the residual volume to the portion of the hearing aid housing facing outside the ear. The vent facilitates transmission of acoustic energy from one side of the hearing aid to the other so that the ear canal is not completely blocked. The vent thus reduces occlusion effects by, first, providing a passageway to permit the body-conducted portion of a user's own voice to dissipate and, second, equalizing the atmospheric pressure between the air in the outside surroundings and in the residual volume. One of the disadvantages of a vent, however, is that the vent also provides an acoustic bypass to the normal signal path via the hearing aid components (for example, the microphone, the signal processor, and the receiver) that may hamper the operation of the hearing aid, causing, for example, feedback instability and a reduction of directionality for directional hearing instruments (this is further described in an article by J. Mejia, H. Dillon, M. Fisher, entitled, "Active cancellation of occlusion: An electronic vent for hearing aids and hearing protectors", J. Acoust. Soc. Am. 124 (1), July 2008, pp. 235-240, which is incorporated by reference herein).

More recently, hearing aids have been constructed with active occlusion reduction (AOR) circuitry. U.S. Patent Publication 2008/0063228 ("Mejia, et al."), which is incorporated by reference herein, shows a hearing aid having AOR circuitry that reduces occlusion by electro-acoustic means. Hearing aids with AOR circuitry generally comprise a second input transducer (referred to as an "AOR microphone" or "internal microphone") that is located inside the hearing aid housing facing the residual volume of the ear canal and that picks up all sounds, including occlusion sounds in the residual volume. The picked-up sounds are processed and combined with the processed external sounds picked up by the external microphone. The hearing aid having AOR circuitry treats the occlusion sounds in the residual volume as an error in a closed-loop feedback system. In particular, the hearing aid having AOR circuitry uses the occlusion sound signals to generate compensating sound signals ("anti-occlusion signals" or "occlusion-negating sounds") that are projected by the receiver into the residual volume (which also projects the hearing-loss compensated sounds). The occlusion sounds in the residual volume get compensated as they combine with occlusion-negating sounds that the hearing aid generates. A hearing aid having AOR circuitry is typically still configured to have a conventional vent as well, with comparatively small dimensions, not to address occlusion reduction directly but to provide frequency response stability and balance barometric pressure differentials.

However, due to the limited bandwidth of hearing aid AOR transducers (specifically, the receiver and the AOR microphone) as well as processing delays, one adverse effect of a hearing aid having AOR circuitry is that the negative feedback of the closed-loop AOR system at 100-1000 Hz turns into positive feedback below 100 Hz, creating a gain boost between 10 and 100 Hz. A well-tuned and optimized hearing aid having AOR circuitry typically has a resonance peak of 5-10 dB between 10 and 100 Hz. As a result, sound in the frequency range of the resonance peak which is entering the hearing aid is amplified. This low frequency amplification is perceived as a very annoying artifact to the user.

Hearing aids with a vent or AOR circuitry or both also may be adversely affected by walk-induced head vibrations (WIHV). This is described in detail in Technical Bulletin TB5 by Knowles Electronics, Inc. entitled, "Walk Induced Head Vibrations and Hearing Aid Design", pp 1-4 (not dated). The Technical Bulletin describes walk induced head vibrations (WIHV) and its consequences for the operation of a hearing aid, specifically pointing out as a problem a "... resonance between 20 and 30 Hz due to the head mass resting on the neck stiffness . . . ." A hearing aid with a conventional vent may be affected by walk induced head vibrations. In particular, the external microphone may pick up the vibrational energy and convert it to signals that could overload the hearing aid circuitry and the receiver, thereby, creating distortions. A hearing aid with AOR circuitry is much more sensitive to WIHV because such vibrations create a sound pressure inside the residual volume of the occluded ear canal. The internal microphone can pick up the vibrational sound pressure and feed it to the AOR circuitry that, as noted above, has a resonance between 10 and 100 Hz. As a result, the AOR circuitry gets overloaded by WIHV signals and creates strong audible distortions.

SUMMARY OF THE INVENTION

The aforementioned problems are obviated by providing a hearing aid, comprising an occlusion reduction system having a tuned resonator. The occlusion reduction system may comprise active occlusion reduction circuitry and a ventilation channel extending through the housing of the hearing aid along its length, said vent having the tuned resonator located at the one end of the ventilation channel that faces away from the user. The tuned resonator may be shaped and sized to entirely cover the one end of the ventilation channel. Further, the tuned resonator may be tuned to a resonance frequency between 10 and 100 Hz. Alternatively, the tuned resonator may be tuned to a resonance frequency of 30 Hz. Alternatively, the tuned resonator may be tuned to a resonance frequency that minimizes distortions in the frequency response of the hearing aid caused by walk-induced head vibrations.

A hearing aid incorporating a tuned resonator could then comprise an external microphone that converts ambient sounds originating outside the ear into first representative electrical signals; an internal microphone that converts sounds originating inside the ear canal, including at least occlusion sounds, into second representative electrical signals; a signal processing system operatively coupled between the external microphone and the internal microphone that modifies and combines the first and second electrical signals to generate third representative electrical signals; a receiver that converts the third representative electrical signals into hearing-loss compensating sounds and occlusion-negating sounds and projects the hearing-loss compensating sounds and occlusion-negating sounds into the ear canal; a vent, extending from the rear of the hearing aid housing to the front of the hearing aid housing, having a first end facing outside the ear and a second end facing the ear canal; and a tuned piston and a flexible surround combination that is situated at the front of the hearing aid housing and that covers the first end of the vent.

The tuned piston and the flexible surround combination may be shaped and sized to completely cover the first end of the vent. Also, the tuned piston may be formed as a rigid disk and the flexible surround may be formed as an elastic membrane that extends from the disk to either the housing or to the inside surface of the first end of the vent, said disk being suspended across the first end of the vent by the membrane. In such case, the rigid disk may be attached along its entire perimeter to the membrane and the membrane may be attached along its entire outer perimeter to either the housing or to the inside surface of the first end of the vent. Also, the disk may be formed with a diameter in the range of 1-3 mm.

The tuned piston and the flexible surround combination may form a resonator and may be tuned to a resonance frequency between 10 and 100 Hz. Alternatively, the tuned resonator may be tuned to a resonance frequency that counteracts a portion of the sound pressure inside the residual volume of the occluded ear canal caused by walk-induced head vibrations.

DESCRIPTION OF THE DRAWINGS

For a better understanding of the invention, reference is made to the following description of an exemplary embodiment thereof, and to the accompanying drawings, wherein.

DETAILED DESCRIPTION

Figure 1:
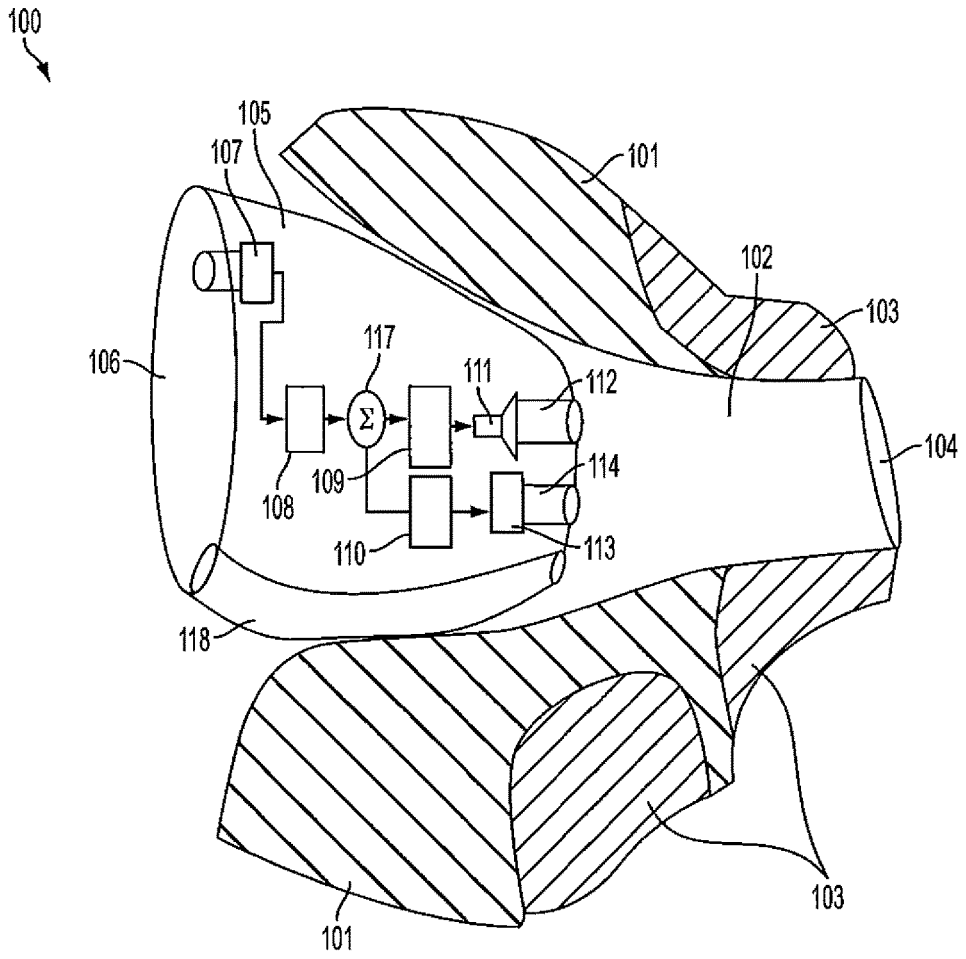
FIG. 1 is a diagrammatic representation of a hearing aid having active occlusion reduction (AOR) circuitry.

FIG. 1 is a diagrammatic representation of a hearing aid 100 having active occlusion reduction (AOR) circuitry (such a hearing aid is described further in U.S. Patent Publication 2008/0063228 ("Mejia, et al.") and the Meija et al article, both described above). The hearing aid 100 is shown inserted in the outside end of an ear canal 102 of a user that is surrounded by soft ear tissue 101 and bony tissue 103. An ear drum 104 is located at the inside end of the ear canal 102. The hearing aid 100 comprises a housing or shell 105 that defines a generally closed cavity therein in which are arranged the hearing aid components. The hearing aid 100 is typically configured to be snugly fit in a user's ear so that outside end of the aid 100 faces the outside surroundings; the middle portion of the aid 100 rests in and blocks the ear canal 102 along the soft ear tissue 101; and the inside end of the aid 100 faces the residual volume of the unblocked portion of the ear canal 102 defined by the housing 105 of the hearing aid 100 and the ear drum 104. The residual volume typically encompasses soft ear tissue 101 as well as bony tissue 103 of the ear canal 102. The outside end of the aid 100 has a faceplate 106 that generally provides access to the internal hearing aid components. The hearing aid 100 may be made of conventional materials and may be manufactured by various methods. The hearing aid 100 also may be configured in various forms.

The hearing aid 100 components include but are not limited to a power source (not shown), typically a battery, and an input transducer 107, for example, a microphone. These components are conventional and well known, and can be operatively connected in well-known manners. The input transducer 107 is also referred to as an external microphone and serves to receive acoustic signals, i.e., sounds, from the outside surroundings and convert the sounds into electrical signals for further processing by the other components of the aid 100. The external microphone 107 is arranged within the aid cavity so that its sound input port is adjacent to and operatively connected with an opening in the faceplate 106. The aid 100 may also include a microphone sound tube that may be integrally formed in the housing 105 or the external microphone 107 and that extends from the input port of the external microphone 107 to the outside surface of the faceplate 106 to establish an acoustic pathway between the external microphone 107 and the outside surroundings.

The hearing aid 100 components further include an output transducer 111, referred to as a receiver, and signal processing circuitry. The signal processing circuitry includes but is not limited to an amplifier 108 that amplifies the converted signals from the external microphone 107 and a signal processor 109 that modifies the converted signals, for example, dampens and/or filters interference signals. As described below in more detail, a summation circuit 117 of active occlusion reduction (AOR) circuitry is connected to the signal path of the signal processing circuitry so that the converted signals are first input into the summation circuit 117 and the summation circuit 117 output is modified by the signal processor 109. The receiver 111 serves to receive the processed signals from the signal processing circuitry, convert the signals into acoustic signals, and project the acoustic signals into the residual volume of the ear canal 102. The receiver 111 is arranged within the aid cavity so that its sound output port is adjacent to and operatively connected with an opening in the housing 105 facing the residual volume. The aid 100 may also include a receiver sound tube 112 that may be integrally formed in the housing 105 or the receiver 111 and that extends from the output port of the receiver 111 to the outside surface of the housing 105 to establish an acoustic pathway between the receiver 111 and the residual volume.

The hearing aid 100 components further include active occlusion reduction (AOR) circuitry. The AOR circuitry includes a second input transducer 113, for example, a microphone. The second input transducer 113 is also referred to as an AOR microphone or internal microphone and serves to receive acoustic signals, i.e., sounds, from the residual volume and convert the sounds into electrical signals for further processing by an AOR microphone processor 110 of the AOR circuitry. The AOR microphone processor 110 serves to modify the converted signals. The summation circuit 117 of the AOR circuitry receives the processed signals from the AOR microphone processor 110 and the converted signals from the amplifier 108. The signal processor 109 receives and modifies the summation circuit 117 output. The receiver 111 receives the processed signals from the signal processor 109, converts the signals into acoustic signals, and projects the acoustic signals into the residual volume of the ear canal 102. Alternatively, the summation circuit 117 may be connected to the signal path of the signal processing circuitry to receive the processed signals from the signal processor 109, rather than the converted signals from the amplifier 108, and the processed signals from the AOR microphone processor 110 and to output a combined signal to the receiver 111. The receiver 111, the signal processing circuitry, and the AOR circuitry are conventional components and can be operatively connected in various well-known manners.

Similar to the other transducers 107, 111, the AOR microphone 113 is arranged within the aid cavity so that its sound input port is adjacent to and operatively connected with an opening in the housing 105 facing the residual volume. The aid 100 may also include an AOR microphone sound tube 114 that may be integrally formed in the housing 105 or the AOR microphone 113 and that extends from the input port of the AOR microphone 113 to the outside surface of the housing 105 to establish an acoustic pathway between the AOR microphone 113 and the residual volume. Either the receiver 111 or the AOR microphone 113, or both, are configured to assist the AOR circuitry in achieving occlusion reduction.

To achieve barometric pressure relief, the hearing aid 100 may include a vent 118 in the housing 105. The vent 118 can be formed in various ways, for example, as a thin hose or a tube extending through the housing 105, or as a channel formed along the housing 105 outside surface, or as a passage formed in an outside wall of the housing 105. The vent 118 facilitates transmission of acoustic energy from one end of the hearing aid 100 to the other so that the ear canal 102 is not completely blocked.

Figure 2:
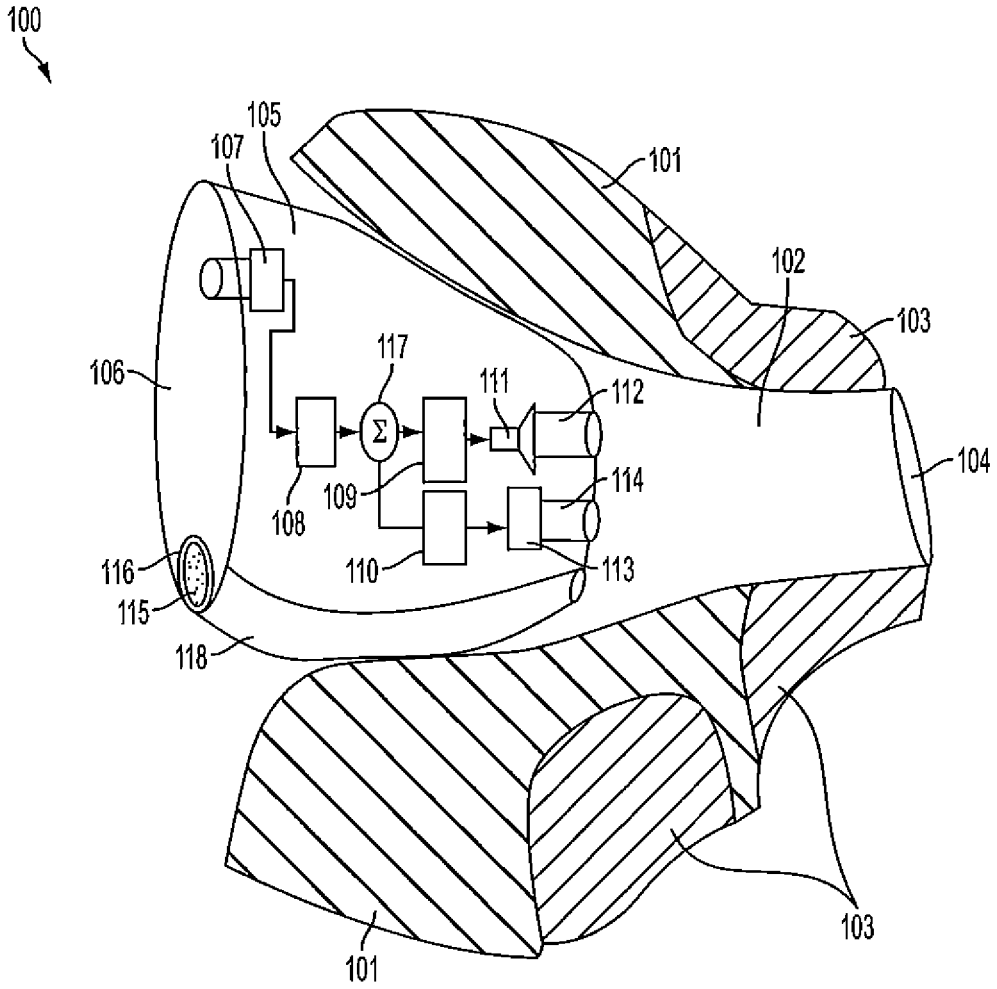
FIG. 2 is a diagrammatic representation of the hearing aid of FIG. 1 constructed according to the invention.
Figure 3:
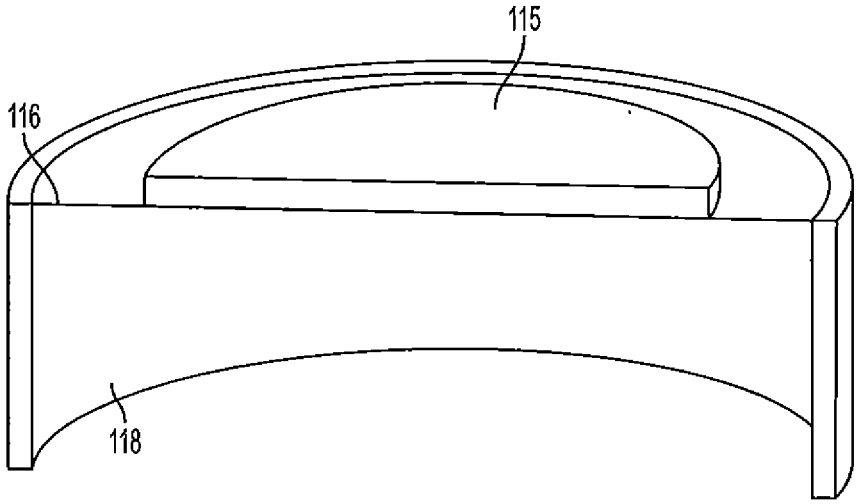
FIG. 3 is a diagrammatic representation of a tuned piston and flexible surround of the hearing aid of FIG. 2.

FIG. 2 shows the hearing aid 100 further comprising a tuned piston 115 and a flexible surround or suspension 116 that cover the end of the vent 118 which faces the outside surroundings. The piston 115 and the surround 116 combination are assembled on the faceplate 106 and shaped and sized to entirely cover the outside end of the vent 118 that is situated on the faceplate 106. The mass of the piston 115 and the compliance of the surround or suspension 116 form a resonator and may be adjusted or tuned so the resonator has a resonance frequency between 10 and 100 Hz (i.e., it will reflect waves within this frequency range). Compliance, also known as acoustic capacitance, is the inverse of stiffness and is described by the ratio between the resulting displacement of a deformable elastic medium to the steady force acting on the medium. FIG. 3 shows a side cut-away view of the piston 115 and the surround 116 covering the outside end of the vent 118 at the faceplate 106. The piston 115 may be constructed as a metal disk that is attached along its entire circumference/perimeter to the surround 116. The piston 115 may typically have a diameter of 1-3 mm. The surround 116, in turn, may be a thin, stretched plastic membrane that extends from the piston 115 to the inside surface of the vent 118 or to the faceplate 106. The surround 116 is attached along its entire outer circumference/perimeter to the inside surface of the vent 118 or to the faceplate 106. Each of the several elements may be attached to another respective element by glue or other appropriate means. The piston 115 may also use other rigid materials besides metal to form the disk and the surround may use other elastic materials besides plastic to form the membrane. Further, the piston 115 and the surround 116 may be sized and shaped differently than described to form a resonator.

In operation, the external microphone 107 picks up sounds from the outside surroundings of the ear via its sound input port. The external microphone 107 converts the sounds into electrical signals that are passed to the signal processing circuitry of the aid 100 and, in particular, the amplifier 108 which amplifies the electrical signals. The converted signals are then passed through a summation circuit 117 of the AOR circuitry which passes its output to the signal processor 109. The signal processor 109 modifies the received signals, for example, by dampening and/or filtering interference, and passes processed signals to the receiver 111. The receiver 111 converts the processed signals into acoustic signals and projects, via its sound outlet port, the acoustic signals into the residual volume of the ear canal 102. At the same time and separately, the AOR microphone 113 picks up acoustic signals from the residual volume via its sound input port and converts the acoustic signals into electrical signals that are passed to the AOR microphone processor 110. The picked-up acoustic signals include both the acoustic signals projected by the receiver 111 and any occlusion sounds in the residual volume from various sources, including body-conducted sounds. The AOR microphone processor 110 modifies the converted signals, for example, by amplifying and/or filtering. The summation circuit 117 combines the processed internal sounds with the converted signals outputted from the external microphone 107 and the associated amplifier 108. The signal processor 109 receives and modifies the summation circuit 117 output and the receiver 111 converts the processed signals from the signal processor 109 into acoustic signals and projects the acoustic signals into the residual volume. Alternatively, the various components may be configured so that the summation circuit 117 is connected to the signal path of the signal processing circuitry to receive the processed signals from the signal processor 109, rather than the converted signals from the amplifier 108, and the processed signals from the AOR microphone processor 110 and to output a combined signal to the receiver 111. In either case, the projected acoustic signals are compensated for any occlusion effects.

As mentioned above, the AOR microphone 113 also picks up walk-induced head vibrations (WIHV) that create sound pressure inside the residual volume of the occluded ear canal 102 and passes them onto the AOR circuitry. However, the combination of the tuned piston 115 and the surround 116 allows the aid 100 to remove or counteract a substantial portion of the sound pressure caused by WIHV. By tuning the piston 115 and the flexible surround 116 with a resonance frequency that coincides with the WIHV frequencies of most concern (i.e., between 10-100 Hz), the resonator action of the two elements causes a reflection of WIHV having these frequencies when they enter the vent 118. In this way, the wave energy of the WIHV is partially depleted and a substantial portion of the sound pressure caused by the WIHV is removed or counteracted.

Figure 4:
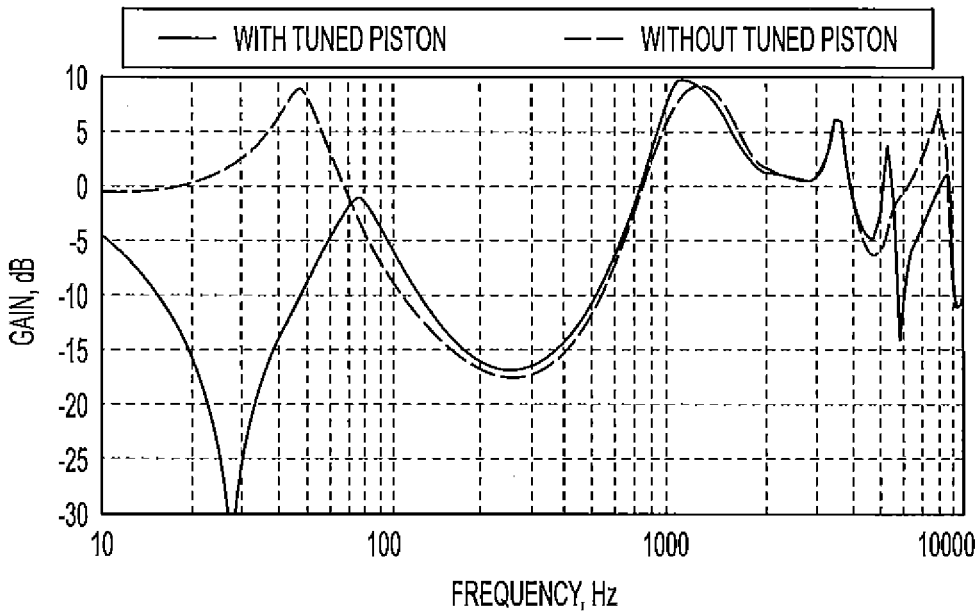
FIG. 4 is a graph of simulated closed loop frequency responses of the receivers of the respective hearing aids of FIGS. 1 and 2.

FIG. 4 shows a comparison between simulated closed loop responses of the hearing aid 100 with AOR circuitry and without the piston 115/surround 116 combination (shown in dotted line) and of the hearing aid 100 with AOR circuitry and with the piston 115/surround 116 combination (shown in solid line). The piston 115/surround 116 is tuned to a resonance frequency of 30 Hz. As described above, the figure shows a gain boost and resonance peak of 5-10 dB between 10 and 100 Hz for the hearing aid 100 with AOR circuitry and without the tuned piston 115/surround 116 combination. The figure also shows, in contrast, a gain reduction between 10 and 100 Hz for the hearing aid 100 with AOR circuitry and with the piston 115/surround 116 combination. A hearing aid 100 constructed in this fashion strongly decreases the low frequency amplification effect (and resulting occlusion artifacts). Moreover, WIHV signals are mainly removed or minimized and the hearing aid 100 achieves occlusion reduction with less audible distortions.

Other modifications are possible within the scope of the invention. For example, the signal processing circuitry and the AOR circuitry are conventional and well known components, and can be configured and operatively connected in well-known ways other than those described above. Further, the hearing aid 100 components may be analog or digital components, or mixed, as preferred.

Importantly, the hearing aid 10 may be a behind-the-ear (BTE) type with an earmold worn in the ear or any other acoustic-controlling device that either partially or completely closes off the ear canal from the surroundings outside the ear, for example, an in-the-ear headset or a sound protector. A BTE hearing aid is commonly used by a user with severe hearing loss who requires high-power amplification. A BTE hearing aid separates the receiver from the main body of the aid and may mount it directly in an earmold that is snugly fit into the user's ear canal. A BTE hearing aid having AOR circuitry also has an AOR microphone that may be mounted directly in the earmold, affording improved frequency response.

What is claimed is:

1. A hearing aid, comprising:

an occlusion reduction system having a tuned resonator;

a hearing aid housing having a rear end and a front end;

a vent, extending from the rear end of the hearing aid housing to the front end of the hearing aid housing, said vent having a first end facing outside the ear and a second end facing the ear canal; and a tuned piston and a flexible surround combination covering said vent, the tuned piston and the flexible surround combination forming the tuned resonator.

2. The hearing aid of claim 1, wherein the occlusion reduction system comprises active occlusion reduction circuitry and a ventilation channel extending through the housing of the hearing aid along its length, said vent having the tuned resonator located at the one end of the ventilation channel that faces away from the user.

3. The hearing aid of claim 2, wherein the tuned resonator is shaped and sized to entirely cover the one end of the ventilation channel.

4. The hearing aid of claim 1, wherein the tuned resonator is tuned to a resonance frequency between approximately 10 and 100 Hz.

5. The hearing aid of claim 1, wherein the tuned resonator is tuned to a resonance frequency of approximately 30 Hz.

6. The hearing aid of claim 1, wherein the tuned resonator is tuned to a resonance frequency that minimizes distortions in the frequency response of the hearing aid caused by walk-induced head vibrations.

7. A hearing aid, comprising:

a. an external microphone that converts ambient sounds originating outside the ear into first representative electrical signals;

b. an internal microphone that converts sounds originating inside the ear canal, including at least occlusion sounds, into second representative electrical signals;

c. a signal processing system operatively coupled between the external microphone and the internal microphone that modifies and combines the first and second electrical signals to generate third representative electrical signals;

d. a receiver that converts the third representative electrical signals into hearing-loss compensating sounds and occlusion-negating sounds and projects the hearing-loss compensating sounds and occlusion-negating sounds into the ear canal;

e. a vent, extending from the rear of the hearing aid housing to the front of the hearing aid housing, having a first end facing outside the ear and a second end facing the ear canal; and f. a tuned piston and a flexible surround combination that is situated at the front of the hearing aid housing and that covers the first end of the vent.

8. The hearing aid of claim 7, wherein the tuned piston and the flexible surround combination is shaped and sized to completely cover the first end of the vent.

9. The hearing aid of claim 7, wherein the tuned piston is formed as a rigid disk and the flexible surround is formed as an elastic membrane that extends from the disk to either the housing or to the inside surface of the first end of the vent, said disk being suspended across the first end of the vent by the membrane.

10. The hearing aid of claim 9, wherein the rigid disk is attached along its entire perimeter to the membrane and the membrane is attached along its entire outer perimeter to either the housing or to the inside surface of the first end of the vent.

11. The hearing aid of claim 9, wherein the disk is formed with a diameter in the range of approximately 1-3 mm.

12. The hearing aid of claim 7, wherein the tuned piston and the flexible surround combination form a resonator.

13. The hearing aid of claim 12, wherein the resonator is tuned to a resonance frequency between approximately 10 and 100 Hz.

14. The hearing aid of claim 12, wherein the tuned resonator is tuned to a resonance frequency that counteracts a portion of the sound pressure inside the residual volume of the occluded ear canal caused by walk-induced head vibrations.

* * * * *